US006318310B1

(12) United States Patent
Clarke

(10) Patent No.: US 6,318,310 B1
(45) Date of Patent: Nov. 20, 2001

(54) INTERNAL COMBUSTION ENGINE

(75) Inventor: John M. Clarke, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/589,936

(22) Filed: Jun. 7, 2000

Related U.S. Application Data

(60) Provisional application No. 60/147,426, filed on Aug. 5, 1999.

(51) Int. Cl.[7] ..... F02B 33/22
(52) U.S. Cl. ..... 123/70 R; 60/620
(58) Field of Search ..... 123/70 R, 72, 123/316, 560; 60/620

(56) References Cited

U.S. PATENT DOCUMENTS

| | | | | |
|---|---|---|---|---|
| 1,601,548 | | 9/1926 | Zier et al. . | |
| 1,636,937 | | 7/1927 | Hult . | |
| 1,638,287 | * | 8/1927 | Burtnett | 123/58.1 |
| 2,309,968 | * | 2/1943 | Marburg | 60/620 |
| 3,623,463 | | 11/1971 | Vries . | |
| 3,880,126 | | 4/1975 | Thurston et al. . | |
| 4,159,699 | * | 7/1979 | McCrum | 60/620 |
| 4,174,683 | | 11/1979 | Vivian . | |
| 4,202,300 | | 5/1980 | Skay . | |
| 4,248,198 | | 2/1981 | Deutschmann et al. . | |
| 4,458,635 | | 7/1984 | Beasley . | |
| 4,565,167 | | 1/1986 | Bryant . | |
| 4,860,716 | | 8/1989 | Deutschmann . | |
| 5,072,589 | | 12/1991 | Schmitz . | |
| 5,265,564 | | 11/1993 | Dullaway . | |
| 5,271,229 | | 12/1993 | Clarke et al. . | |
| 5,566,549 | | 10/1996 | Clarke . | |

FOREIGN PATENT DOCUMENTS 2 071 210 A 9/1981 (GB) .

* cited by examiner

*Primary Examiner*—Noah P. Kamen
(74) *Attorney, Agent, or Firm*—Keith P. Roberson

(57) ABSTRACT

Most internal combustion engines may be optimized for either power or efficiency. A dual mode internal combustion engine may operate in either a power mode or an efficient mode. The dual mode internal combustion engine has two four-cycle combustion chambers and a two-cycle compression/expansion chamber. The valve system is set up to introduce a fluid charge into the compression/expansion cylinder during the power mode. The fluid charge is compressed in the compression/expansion chamber and one of the combustion chambers. During the efficiency mode, the fluid charge is expanded first in one of the combustion chambers and further expanded in the compression/expansion chamber.

14 Claims, 5 Drawing Sheets

Fig. 2a.
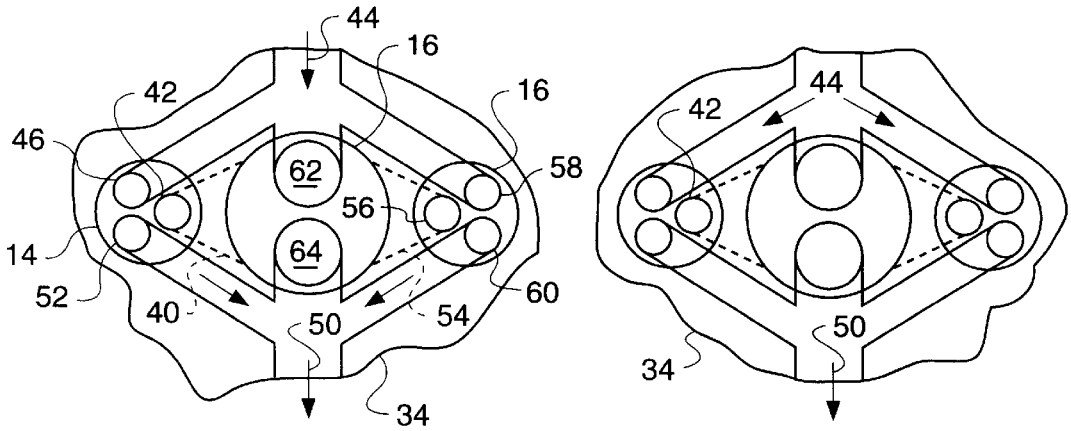
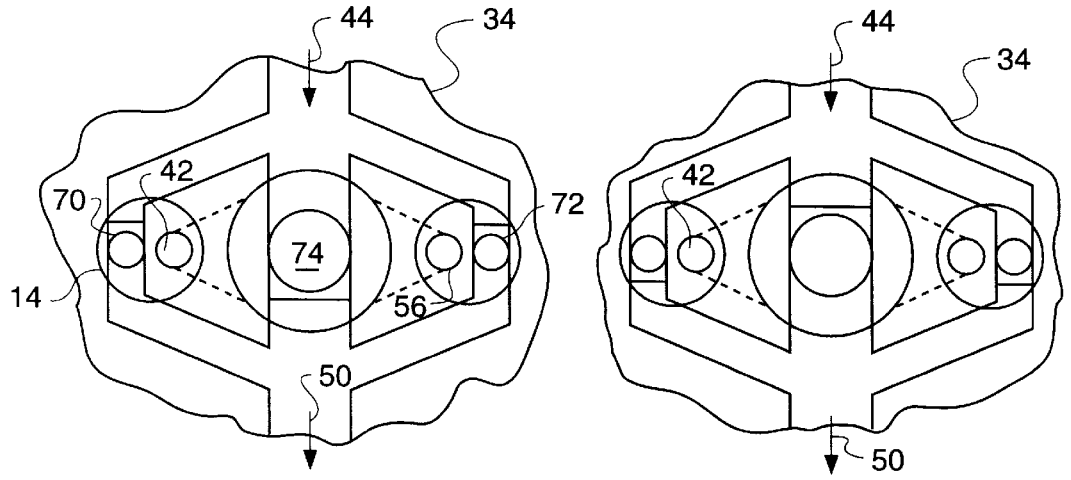
Fig. 2b.

INTERNAL COMBUSTION ENGINE

This application claims the benefit of prior provision patent application Ser. No. 60/147,426 filed Aug. 5, 1999.

TECHNICAL FIELD

This invention relates generally to an internal combustion engine and more specifically to controlling gas flow through the internal combustion engine having a combustion chamber operating in four-cycle mode and a compression/expansion chamber operating in two-cycle mode.

BACKGROUND ART

Most reciprocating piston internal combustion engines operate by converting heat and/or chemical energy into mechanical energy. Most of these internal combustion engines go through a series of processes known as thermodynamic cycles. Ideals thermodynamic cycles represent work input into a system, work gained from the system, and net work. Examining these ideal cycles shows certain inefficiencies.

In U.S. Pat. No. 3,623,463 issued to De Vries on Nov. 30, 1971, a system describes compressing and combusting an air fuel mixture in one cylinder and expanding and exhausting combustion gasses in a separate cylinder. This system effectively increases the expansion ratio of an engine by pairing a compression/combustion cylinder with an expansion/exhaust cylinder. In the limit these systems are called Atkinson cycle engines. These systems tend to increase engine size. Further, increased friction in a piston type engine may negate gains in efficiency.

In addition to increasing efficiencies, examination of the thermodynamic cycles shows that maximum power available from a given cycle depends on compression ratio instead of expansion ratio. For conventional engines, both expansion ratio and compression ratio are directly related to a cylinder bore and a piston stroke. In a typical four-cycle engine, the cylinder bore and the piston stroke remain constant during compression, expansion, exhaust, and induction cycles. U.S. Pat. No. 1,601,548 issued to Zier et al on Sep. 28, 1926 shows an engine having a compression cylinder having a larger bore taking in air on its down stroke and delivering compressed air to one of two smaller cylinders on its upward stroke. The two smaller cylinders are then used to combust, expand, and exhaust a fuel air mixture. A turbocharger may produce similar power results while reducing size and increasing efficiency relative to using a compression cylinder. However, turbochargers tend to require time for the engine to reach a certain speed before becoming effective. This problem is to referred to a turbo lag.

In an attempt to optimize both power and efficiency, U.S. Pat. No. 5,566,549 issued to Clarke on Oct. 22, 1996 shows an engine having a compression/induction cylinder, a combustion cylinder, and an expansion/exhaust cylinder. Both the compression/induction cylinder and the expansion/exhaust cylinder have larger bores than the combustion cylinder. This engine improves both efficiency and power. However, the increase in efficiency and power requires an increase in engine size. Typically, a user requires only greater efficiency or greater power but not both at the same time.

The present invention is directed to overcoming one or more of the problems set forth above.

DISCLOSURE OF THE INVENTION

In one aspect the present invention discloses a method of operating an engine in two modes. The engine has a combustion chamber and a compression/expansion chamber. Operating the engine in the first mode involves inducing a fluid charge into the compression/expansion chamber and compressing the fluid charge in the compression/expansion chamber. After inducing the fluid charge into the combustion chamber from the compression/expansion chamber, the fluid charge is further compressed in the combustion chamber. Switching the engine to a second operating mode during some predetermined range of operation causes the first combustion chamber to induce the fluid charge into the combustion chamber. After expanding the fluid charge in the combustion chamber, the fluid charge is exhausted into the compression/expansion chamber. The fluid charge is further expanded in the compression/expansion chamber. In another aspect of the invention an internal combustion engine having a first operating mode and a second operating is disclosed. The engine has a compression/expansion chamber and a combustion chamber. A valve system connects the combustion chamber and the compression/expansion chamber. The valve system allows ambient air to enter compression/expansion chamber during the first operating mode. During the second operating mode, the valve system allows ambient air to be inducted into the combustion chamber.

BRIEF DESCRIPTION OF THE DRAWINGS

FIGS. 2*a–b* shows a horizontal schematic view of the engine in FIG. 1;

BEST MODE FOR CARRYING OUT THE INVENTION

Figure 1:
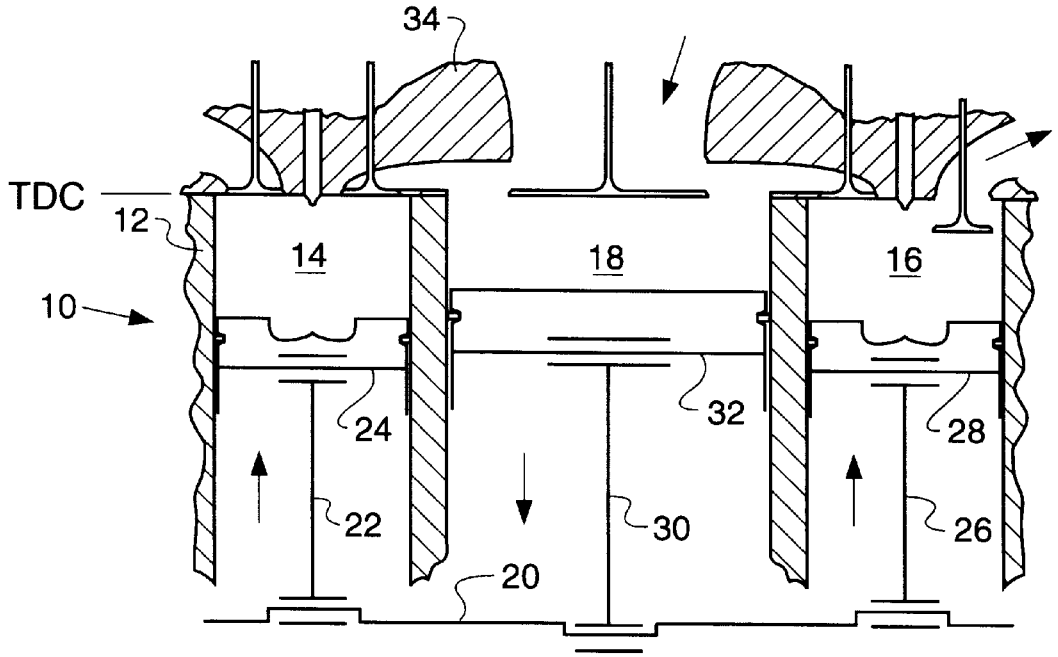
FIG. 1 shows a vertical view of an engine with three cylinders embodying the present invention.

FIG. 1 shows a dual mode internal combustion engine 10 having a cylinder block 12 defining a first combustion chamber 14, a second combustion chamber 16, and a compression/expansion chamber 18. In this application the compression/expansion chamber 18 has about twice as much swept volume as the first combustion chamber 14, and the first combustion chamber has about the same swept volume as the second combustion chamber. Other ratios would also work so long as the compression/expansion chamber 18 has a larger swept volume than either combustion chamber 14, 16.

A crank shaft 20 connects to a first connecting rod 22 connecting to a first combustion piston 24, a second connecting rod 26 connecting to a second combustion piston 28, and a third connecting rod 30 connecting to a compression/expansion piston 32. The first combustion piston 24, second combustion piston 28, and compression/expansion piston 32 move generally axially within the first combustion chamber 14, second combustion chamber 16, and compression expansion chamber 18 respectively. According to the present embodiment, the first combustion piston 24 moves generally in phase with the second combustion piston 28. The compression/expansion piston 32 moves about 180 degrees out of phase with the first combustion piston 24.

A cylinder head 34 attaches to the cylinder block 12 near top dead center (TDC) 36 of axial travel of the pistons 24, 28, and 32. The cylinder head 34 has a valve system best illustrated in FIG. 2. In a first embodiment, FIG. 2*a* shows the valve system using conventional poppet type valves. The first combustion chamber 14 connects to the compression/expansion cylinder 18 through a first bridge conduit 40 formed in the cylinder head 34. In this application, a first bridge valve 42 positioned in the cylinder head 34 has a first position and second position. In the first position, the first combustion chamber 14 fluidly connects with the compression/expansion chamber 18. In the second position, the first bridge valve 42 prevents fluid connection between the first combustion chamber 14 and compression/expansion chamber. An ambient conduit 44 connects the intake system (not shown) with the first combustion chamber 14. A first inlet valve 46 is positioned within said ambient conduit 44. In a first position, the first inlet valve 46 allows the first combustion chamber 14 to fluidly connect with the ambient conduit 44. An exhaust conduit 50 connects to the first combustion chamber 14. A first exhaust valve 52 has a first position and second position. When the first exhaust valve 52 is in a first position, the exhaust conduit 50 and first combustion chamber 14 fluidly connect. The first exhaust valve 52 prevents fluid connection between the first combustion chamber 14 and the exhaust conduit 50 in the second position.

The second combustion chamber 16, similar to the first combustion chamber 14, connects to the compression/expansion chamber 18 through a second bridge conduit 54. A second bridge valve 56 having a first position and second position prevents fluid communication in the second position and allows fluid communication in the first position. A second inlet valve 58 prevents fluid communication between the ambient conduit 44 and the second combustion chamber 16 while in a second position and allows fluid communication while in a first position. A second exhaust valve 60 allows fluid communication between the second combustion chamber 16 and the exhaust conduit 50 while in a first position and prevents fluid communication while in a second position.

The compression/expansion chamber 18 has a third inlet valve 62 and a third exhaust valve 64. The third inlet valve 62 has a first position and second position. In the first position, the third inlet valve 62 allows fluid communication between the ambient conduit 44 and the compression/expansion chamber 18. In the second position, the third inlet valve 62 prevents fluid communication between the ambient conduit 44 and compression/expansion chamber 18. The third exhaust valve 64 has a first position allowing fluid communication between the compression/expansion chamber 18 and the exhaust conduit 50. In a second position, the third exhaust valve 64 prevents fluid communication between the compression/expansion chamber 18 and the exhaust conduit 50.

FIG. 2*b* shows an alternative embodiment of the present invention having switching valves such as a monovalve. The first switching valve 70 replaces both the first inlet valve 46 and the first exhaust valve 52. A second switching valve 72 replaces both the second inlet valve 58 and second exhaust valve 60. The third inlet valve 62 and third exhaust valve 64 are both replaced by a third switching valve 74. In each case the switching valves 70, 72, 74 have a first position, a second position, and a third position. In the first position, each switching valve 70, 72, 74 allows fluid communication between the ambient conduit 44 and respective chambers 14, 16, and 18. Each switching valve 70, 72, 74 allows fluid communication between the respective chambers 14, 16, 18 and the exhaust conduit 50 while in the second position. The third position prevents fluid communication between respective combustion chambers 14, 16, 18 through the respective switching valve 70, 72, 74. The first bridge valve 42 and second bridge valve 56 are unchanged. Other conventional valves may also be used such as sliding valves, gate valves, or ball valves. The valves in this application are electronically controlled and actuated hydraulically. Cam actuated and controlled valves may also be used.

Figure 3A:
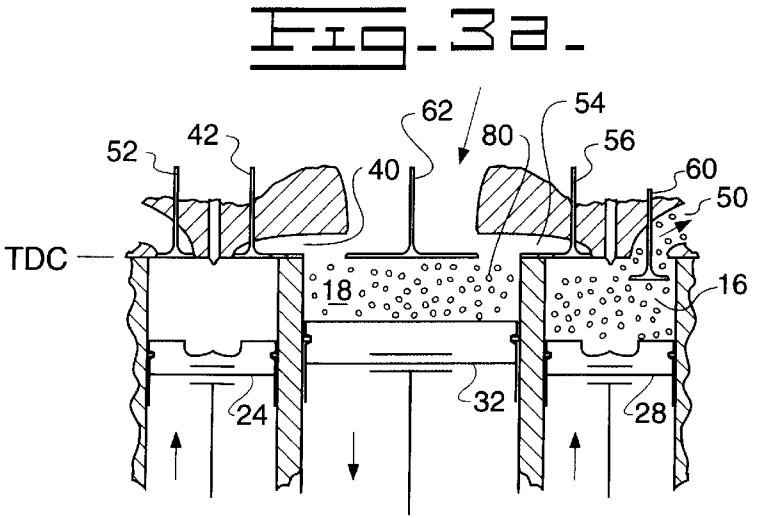
FIGS. 3*a–d* illustrates four operating steps of the engine in the first operating mode.
Figure 3B:
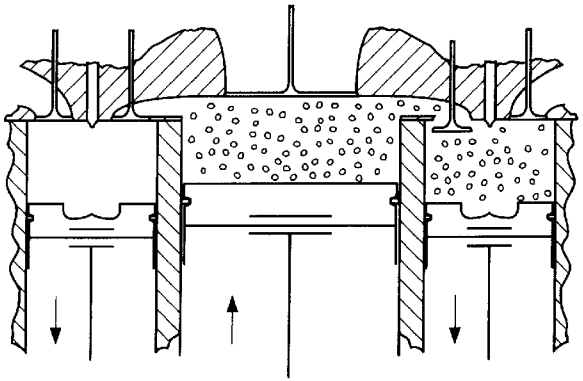
Figure 3C:
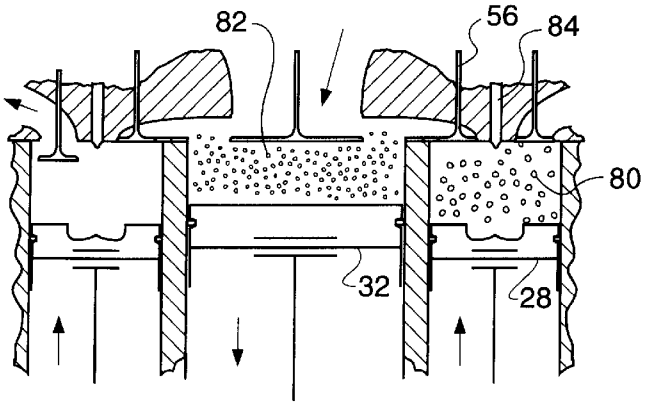
Figure 3D:
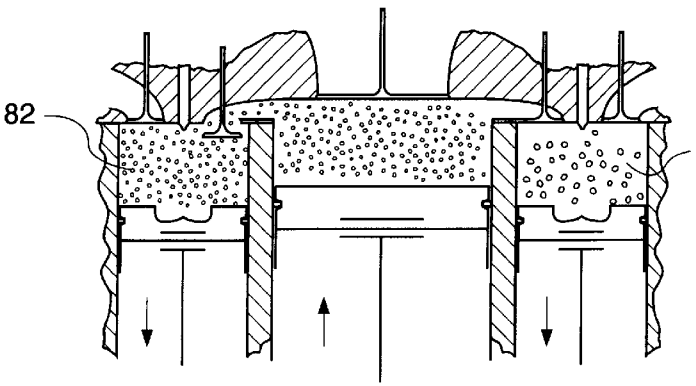

Following a first fluid charge 80 during a power mode as shown in FIG. 3*a,* the compression/expansion piston 32 draws the first fluid charge 80 into the compression/expansion chamber 18 past the third inlet valve 62 while in its first position. The fluid charge 80 in this application is air, but a fuel/air mixture, such as air and natural gas or gasoline, would have similar results. FIG. 3*b* shows the third inlet valve 62 in the second position when the compression/expansion cylinder 32 is moving from bottom dead center (BDC) toward TDC. As the second combustion piston 28 moves from TDC towards BDC and the compression/expansion piston 32 approaches TDC, the second bridge valve 56 is in its first position to allow the first air charge 80 to move from the compression/expansion chamber 18 through the second bridge conduit 54. The second bridge valve 56 as shown in FIG. 3*c* is in its second position as the compression/expansion piston 32 moves toward BDC. As the second combustion piston 28 moves from BDC toward TDC, the second combustion piston 28 further compresses the first fluid charge 80 while the compression/expansion chamber 18 fills with a second fluid charge 82. With the second combustion piston 28 near TDC, the first fluid charge 80 receives a rapid introduction of energy by a spark, fuel injection, or other conventional manner. In this application, the energy introduction comes through injection of a fuel charge (not shown) from a fuel injector 84. Sudden increases in energy result in combustion of the fuel charge and sudden pressure rise in the second combustion chamber 16. Pressures in the second combustion chamber 16 press the second combustion piston 28 back toward BDC as shown by FIG. 3*d.* Downward movement of the second combustion piston 28 causes the crank shaft 20 to act on the third connecting rod 30 pushing the compression/expansion piston 32 toward TDC to compress the second fluid charge 82. When the second combustion piston 28 begins to again move toward TDC in FIG. 3*a,* the second exhaust valve 60 moves toward its first position to allow the first fluid charge 80 to pass into the exhaust conduit 50.

The first combustion chamber 14 undergoes operations similar to the second combustion chamber 16 using the second fluid charge 82. The first combustion chamber 14 leads or lags the second combustion chamber 16 by about two cycles. The first combustion piston 24 expands the second fluid charge 82 during transfer of the first charge 82 from the compression/expansion chamber 18 to the second combustion chamber 16. During compression of the first charge fluid 80 in the second combustion chamber 16, the second fluid charge 82 exhausts from the first combustion chamber 14 past the first exhaust valve 52 into the exhaust conduit 50. The second fluid charge 82 passes through the first bridge conduit 40 past the first bridge valve 42 while the first fluid charge 80 expands in the second combustion chamber 16.

Figure 3F:
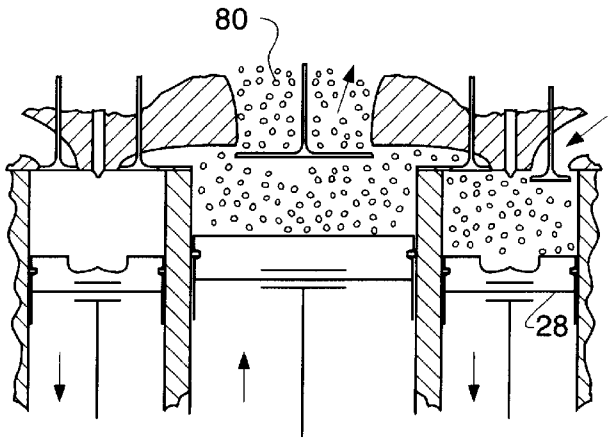
FIGS. 3*e–h* illustrates four operating steps of the engine in the second operating mode.
Figure 3H:
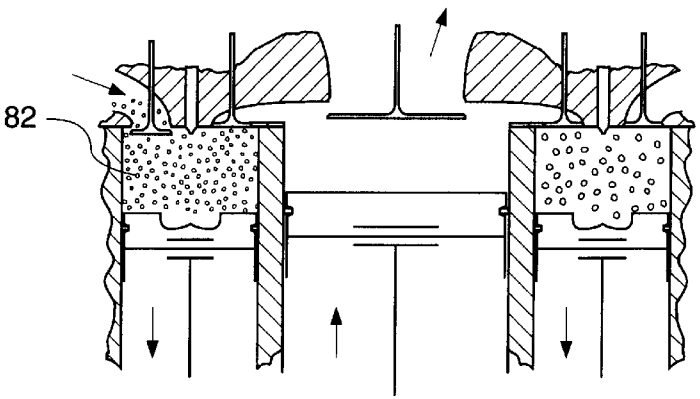
Figure 3E:
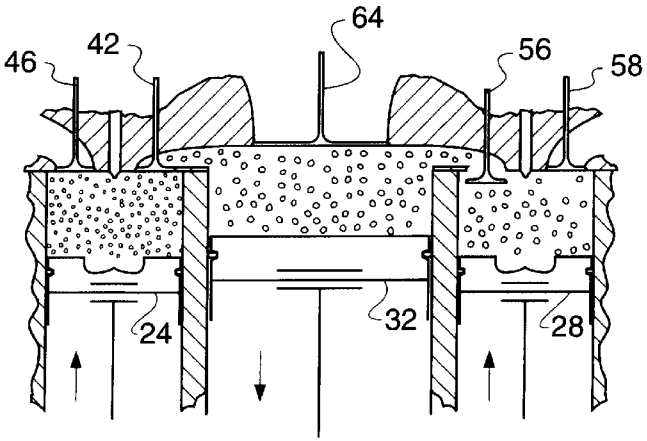
Figure 3G:
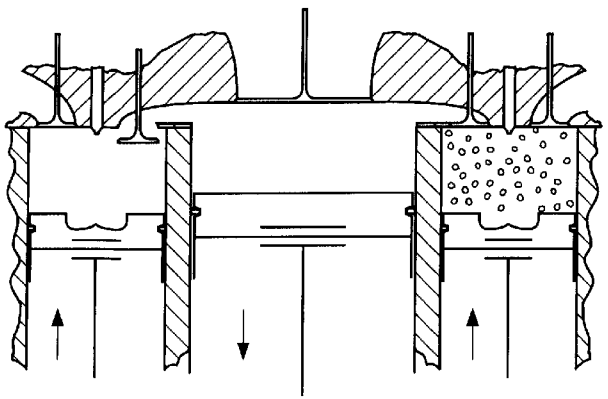

In FIG. 3*f,* the efficiency mode reverses flow through the dual mode internal combustion engine 10 by introducing the first charge 80 into the second combustion chamber 16 directly past the second inlet valve 56 in its first position. While the second combustion piston 28 moves from BDC to TDC, FIG. 3*g* shows the second inlet valve 58 in its second position. As the second combustion piston 28 approaches TDC, the fuel injector 84 adds energy causing rapid pressure rises in the second combustion chamber 16. Large pressures in the second combustion chamber 16, as in the power mode, push the second combustion piston 28 towards BDC. As the second combustion piston 28 moves toward BDC, the second charge 82 is drawn into the first combustion chamber 14 past the first inlet valve 46 in its first position. FIG. 3*e* shows the first fluid charge 82 expanding past the second bridge valve 56 in its first position into the compression/expansion chamber 18. FIG. 3*h* shows the first fluid charge 80 being further expanded into the exhaust conduit 50 past the third exhaust valve 64 in its first position.

Like the power mode, the first combustion chamber 14 in the efficiency mode undergoes operation similar to those in the second combustion chamber 16. The first inlet valve 46, first exhaust valve 52, and first bridge valve 42 lag or lead by two cycles the second inlet valve 58, second exhaust valve 60, and second bridge valve 56.

Figure 4:
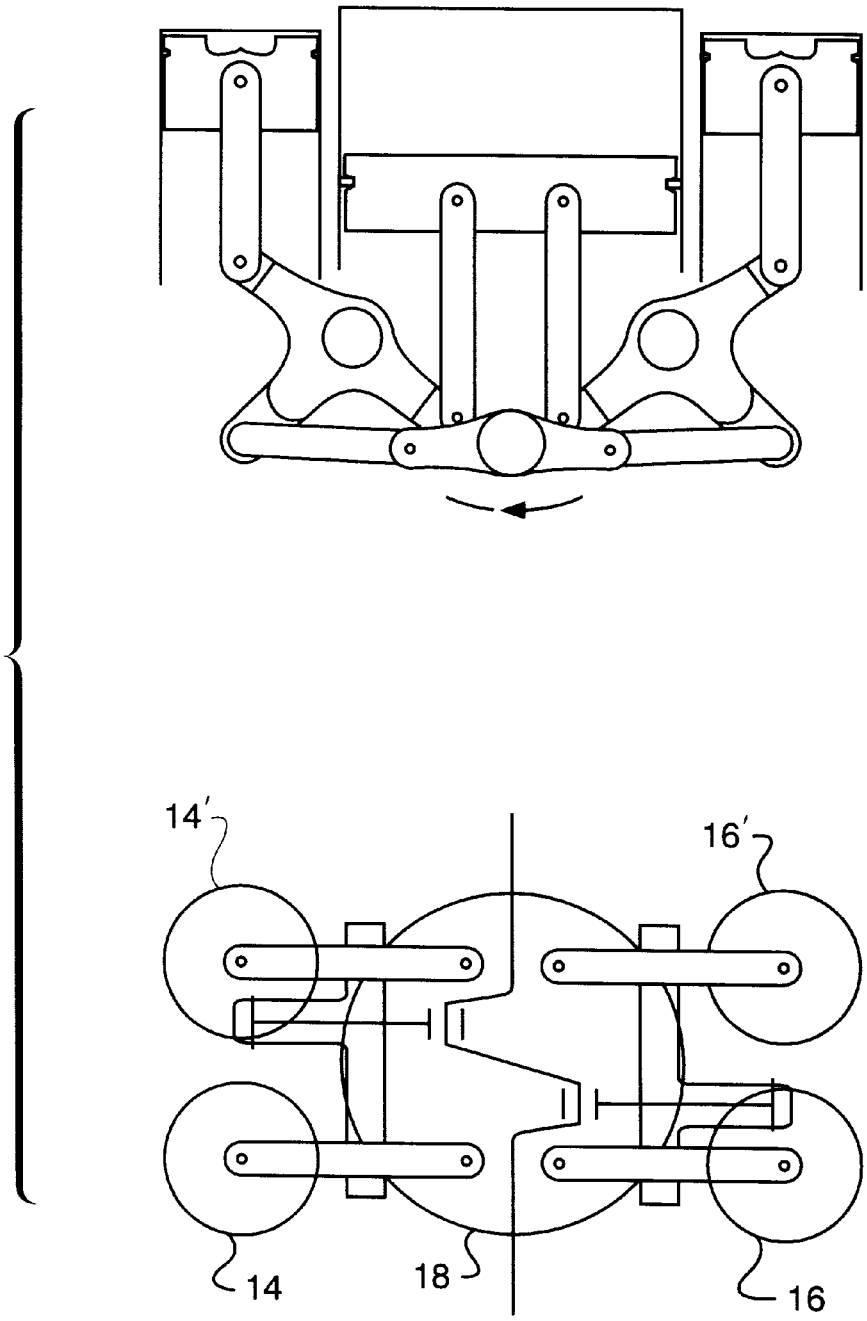
FIG. 4 is a vertical view of an engine with five cylinders embodying the present invention.

Numerous variations may be available using dual mode operation. An alternative embodiment shown in FIG. 4 has four combustion cylinders 14, 14', 16, 16' (where the "'"s represent the added cylinders) and the compression/expansion cylinder. The operation of the alternative embodiment would be generally the same. In this embodiment, the compression/expansion cylinder 18 would have a volume greater than two of the combustion chambers. The engine could be configured as shown or coupled to form even larger engines.

INDUSTRIAL APPLICABILITY

Operating the dual mode internal combustion engine 10 provides an engine being able to exceed power available from similar sized internal combustion engines during its power mode and exceed efficiency of similar sized internal combustion engines in the efficiency mode. In one example, the dual mode engine 10 may exceed the power available from standard four piston engines by over 10 percent. In this example, the compression/expansion chamber 18 has about twice as much volume as one of the combustion chambers 14 or 16. When operating in the efficiency mode, the engine 10 may produce 50 percent of its power and use only about 90 percent of the fuel needed for standard four piston engines. Other considerations include a reduced overall number of components such as pistons, rods, and fuel injectors.

Other aspects, objects, and advantages of this invention can be obtained from a study of the drawings, the disclosure and the appended claims.

What is claimed is:

1. A method of operating an internal combustion engine having a compression/expansion chamber, a first combustion chamber, and a second combustion chamber, said method comprising the steps of:

operating said internal combustion engine in a first operating mode;

inducing a fluid charge into said compression/expansion chamber during said first operating mode;

compressing the fluid charge in said compression/expansion chamber;

inducing the fluid charge into one of said first combustion chamber or said second combustion chamber from said compression/expansion chamber;

further compressing the fluid charge in one of said first combustion chamber or said second combustion chamber;

expanding the fluid charge in one of said first combustion chamber or said second combustion chamber;

exhausting the fluid charge from one of said first combustion chamber or said second combustion chamber;

switching said internal combustion engine to a second operating mode during some predetermined range of operation;

inducing the fluid charge into one of said first combustion chamber or second combustion chamber;

compressing the fluid charge in one of said first combustion chamber or second combustion chamber;

expanding the fluid charge in one of said first combustion chamber or said second combustion chamber;

exhausting the fluid charge from said first combustion chamber or said second combustion chamber to said compression/expansion chamber;

further expanding the fluid charge in said compression/expansion chamber; and exhausting the fluid charge from said compression expansion chamber.

2. The method as specified in claim 1 wherein said compressing the fluid charge and transferring the fluid charge occur simultaneously.

3. The method as specified in claim 1 wherein said exhausting from said first combustion chamber or said second combustion chamber and said expansion in said compression/expansion chamber occur simultaneously.

4. The method as specified in claim 1 wherein first combustion chamber is in said expanding step where said second combustion chamber is in said inducing step.

5. The method as specified in claim 1 further comprising the step injecting a fuel into one of said first combustion chamber or said second combustion chamber during said compressing step.

6. The method as specified in claim 1 wherein said switching is through controlling a first switching valve connecting said first combustion chamber with an ambient conduit, a second switching valve connecting said second combustion chamber with the ambient conduit, a third swithcing valve connecting said compression/expansion chamber with the ambient conduit, a first bridge valve connecting said first combustion chamber with said compression/expansion chamber, and a second bridge valve connecting said second combustion chamber with said compression/expansion cylinder.

7. The method as specified in claim 6 wherein said first switching valve and said second switching valve allow fluid to pass from said first combustion chamber and said second combustion chamber respectively during said exhausting step in said first operating mode.

8. An internal combustion engine having a first operating mode and a second operating mode, said internal combustion engine comprising:

a compression/expansion chamber having a compression/expansion volume;

a first combustion chamber being fluidly connectable with said compression/expansion chamber, said first combustion chamber having a first combustion volume;

a second combustion chamber being fluidly connectable with said compression/expansion chamber, said second combustion chamber having a second combustion volume; and a valve system being connectable with said first combustion chamber, said second combustion chamber, and said compression/expansion chamber, said valve system allowing ambient air to be inducted into said compression/expansion chamber during said first operating mode, said valve system allowing exhaust gas to be exhausted from said compression/expansion chamber to an ambient condition during said second operating mode, said valve system allowing exhaust gas to be exhausted from one of said first combustion chamber or said second combustion chamber to said ambient condition during said first operating mode, and said valve system allowing ambient air to be inducted into in one of said first combustion chamber or said second combustion chamber during said second operating mode.

9. The internal combustion engine as specified by claim 8 wherein said valve system further allows one of said first combustion chamber or said second combustion chamber to induce air from said compression/expansion chamber during said first operating mode and said valve system further allows one of said first combustion chamber or said second combustion chamber to expel exhaust gas into said compression/expansion chamber during said second operating mode.

10. The internal combustion engine as specified in claim 8 wherein said first combustion chamber having a first combustion piston movable therein, said second combustion chamber having a second combustion piston movable axial therein, said compression/expansion chamber has a compression/expansion piston movable therein.

11. The internal combustion engine as specified in claim 10 wherein said compression expansion piston moving about 180 degrees out of phase with said first combustion piston and said second combustion piston.

12. The internal combustion engine as specified in claim 8 wherein said valve system being hydraulically actuated.

13. The internal combustion engine as specified in claim 8 wherein said valve system being electronically controlled.

14. The internal combustion engine as specified in claim 8 wherein said compression/expansion volume being greater than said first combustion volume or said second combustion volume.

* * * * *